US012246264B2

(12) United States Patent
Hsu

(10) Patent No.: US 12,246,264 B2
(45) Date of Patent: Mar. 11, 2025

(54) PLUSH TOY WITH REMOVABLE WIG

(71) Applicant: Great Eastern Entertainment, Co, Compton, CA (US)

(72) Inventor: Kent Hsu, Torrance, CA (US)

( * ) Notice: Subject to any disclaimer, the term of this patent is extended or adjusted under 35 U.S.C. 154(b) by 168 days.

(21) Appl. No.: 17/894,986

(22) Filed: Aug. 24, 2022

(65) Prior Publication Data

US 2023/0390655 A1 Dec. 7, 2023

Related U.S. Application Data

(63) Continuation-in-part of application No. 17/832,504, filed on Jun. 3, 2022, now Pat. No. 11,944,915.

(51) Int. Cl.

| | |
|---|---|
| ***A63H 3/02*** | (2006.01) |
| ***A63H 3/04*** | (2006.01) |
| ***A63H 3/44*** | (2006.01) |
| ***A63H 3/46*** | (2006.01) |

(52) U.S. Cl.

CPC ..... *A63H 3/02* (2013.01); *A63H 3/04* (2013.01); *A63H 3/44* (2013.01); *A63H 3/46* (2013.01)

(58) Field of Classification Search

CPC ..... A63H 3/02; A63H 3/04; A63H 3/44

See application file for complete search history.

(56) References Cited

U.S. PATENT DOCUMENTS 1,359,030 A * 11/1920 Cabana ..... A63H 3/46 446/381
1,374,343 A * 4/1921 Wiener ..... A63H 3/46 446/394
1,509,604 A * 9/1924 Myers ..... A63H 3/46 446/99
2,663,971 A * 12/1953 Ippolito ..... A63H 3/46 446/384
3,982,353 A * 9/1976 Christiansen ..... A63H 3/46 446/97
4,070,790 A * 1/1978 Strongin ..... A63H 3/44 446/394
4,268,991 A * 5/1981 Cotey ..... A63H 3/46 446/373
4,571,209 A * 2/1986 Manning ..... A63H 3/46 446/376
5,630,745 A * 5/1997 Yeh ..... A63H 3/04 446/385

(Continued)

FOREIGN PATENT DOCUMENTS

EP 1946810 A1 7/2008

*Primary Examiner* — John A Ricci

(74) *Attorney, Agent, or Firm* — McConnell Law Firm PC; Robert McConnell

(57) ABSTRACT

A plush toy with a removable wig. The plush toy includes an internal skeleton that provides support for poseable limbs, including arms and legs. These posable limbs may be placed in any configuration desired by the user and are held in place by the internal skeleton. The plush cover is made from polyester plush material but any plush material well known in the art may be used. The interior is stuffed with a variety of stuffing materials including polyester fiber or any other stuffing material well known in the art. Wig may be attachable and detachable from the head or permanently fixed to head by sewing, glue or any other secure attachment means well known in the art.

7 Claims, 4 Drawing Sheets

(56) References Cited

U.S. PATENT DOCUMENTS 5,713,779 A * 2/1998 Chen ..... A63H 3/48 446/353
5,762,531 A * 6/1998 Witkin ..... A63H 3/04 446/374
6,010,388 A * 1/2000 Pillai ..... A63H 3/36 446/391
6,033,284 A * 3/2000 Rodriguez Ferre ..... A63H 3/46 446/378
6,074,270 A * 6/2000 Wilcox ..... A63H 3/04 446/370
6,086,447 A * 7/2000 Tucker ..... A63H 3/36 446/391
6,110,002 A * 8/2000 Langton ..... A63H 3/04 446/373
6,170,721 B1 * 1/2001 Chen ..... A63H 3/003 223/94
6,220,922 B1 * 4/2001 Lee ..... A63H 3/46 446/385
6,422,916 B1 * 7/2002 Enku ..... A63H 3/46 446/376
6,537,130 B1 * 3/2003 Lee ..... A63H 3/04 446/485
6,638,133 B1 10/2003 Brancolino et al.
6,932,669 B2 * 8/2005 Lee ..... B29C 45/14467 446/376
7,479,054 B2 * 1/2009 Wittenberg ..... A63H 9/00 446/376
7,841,921 B2 11/2010 Wong et al.
2002/0002022 A1 * 1/2002 Wilcox ..... A63H 3/46 446/371
2002/0055322 A1 * 5/2002 Lee ..... A63H 3/04 446/373
2003/0036334 A1 * 2/2003 Shamitoff ..... A63H 3/46 446/175
2003/0092354 A1 5/2003 Wexler
2004/0092203 A1 * 5/2004 Lee ..... A63H 3/46 446/268
2010/0035510 A1 * 2/2010 Joubert Nogueroles ..... A63H 3/04 446/374
2014/0199912 A1 * 7/2014 Fish ..... A63H 3/04 446/383
2015/0133022 A1 * 5/2015 Ushiba ..... F16M 13/00 446/73
2015/0375127 A1 * 12/2015 Fukuchi ..... A63H 3/36 446/321

* cited by examiner

PLUSH TOY WITH REMOVABLE WIG

BACKGROUND OF THE INVENTION

Field of the Invention

The present invention relates to plush toys, specifically toys consisting of a soft exterior material covering either a soft or firm stuffing material. Plush toys are made of various exterior materials such as soft boa fabric, tricot fabric, pearl velvet cloth, wide wale soft boa, polar fleece, velboa, printed polyester, polyester plush (pile) material, pile textiles, cotton, mohair, wool, worsted yarn, simulated fur, real fur, silk with a cotton backing, terry cloth and any other fabric well known in the art. These exterior materials are formed of synthetic materials such as polyester, nylon, plastics and/or natural materials such as cotton, wool or real fur. Common stuffing materials may include polyester fiber, polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans.

Plush toys are enjoyed by children and adults alike. Children or adults may use them solely for the enjoyment of play but many adults may collect them for enjoyment or financial gain. Plush toys are often based on characters ranging from zoo/farm animals to characters invented by their manufacturers to famous licensed characters such as super heroes or cartoon characters. Plush toys are a significant market enjoyed by those of all ages and all walks of life.

SUMMARY OF THE INVENTION

The present invention is a plush toy with a removable wig. The plush toy includes an internal skeleton that provides support for poseable limbs, including arms and legs. These posable limbs may be placed in any configuration desired by the user and are held in place by the internal skeleton. The plush cover is made from polyester plush material but any plush material well known in the art may be used. The interior is stuffed with a variety of stuffing materials including polyester fiber or any other stuffing material well known in the art. Wig 101 may be attachable and detachable from the head or permanently fixed to head 102 by sewing, glue or any other secure attachment means well known in the art.

DESCRIPTION OF THE PREFERRED EMBODIMENT

The following detailed description refers to the preferred embodiment of the disclosed invention as shown in the attached figures and in the below description. This detailed description is not meant to limit the scope of the invention in any way but is intended to disclose the preferred embodiment/best mode of the invention at the time of filing this application.

Figure 1:
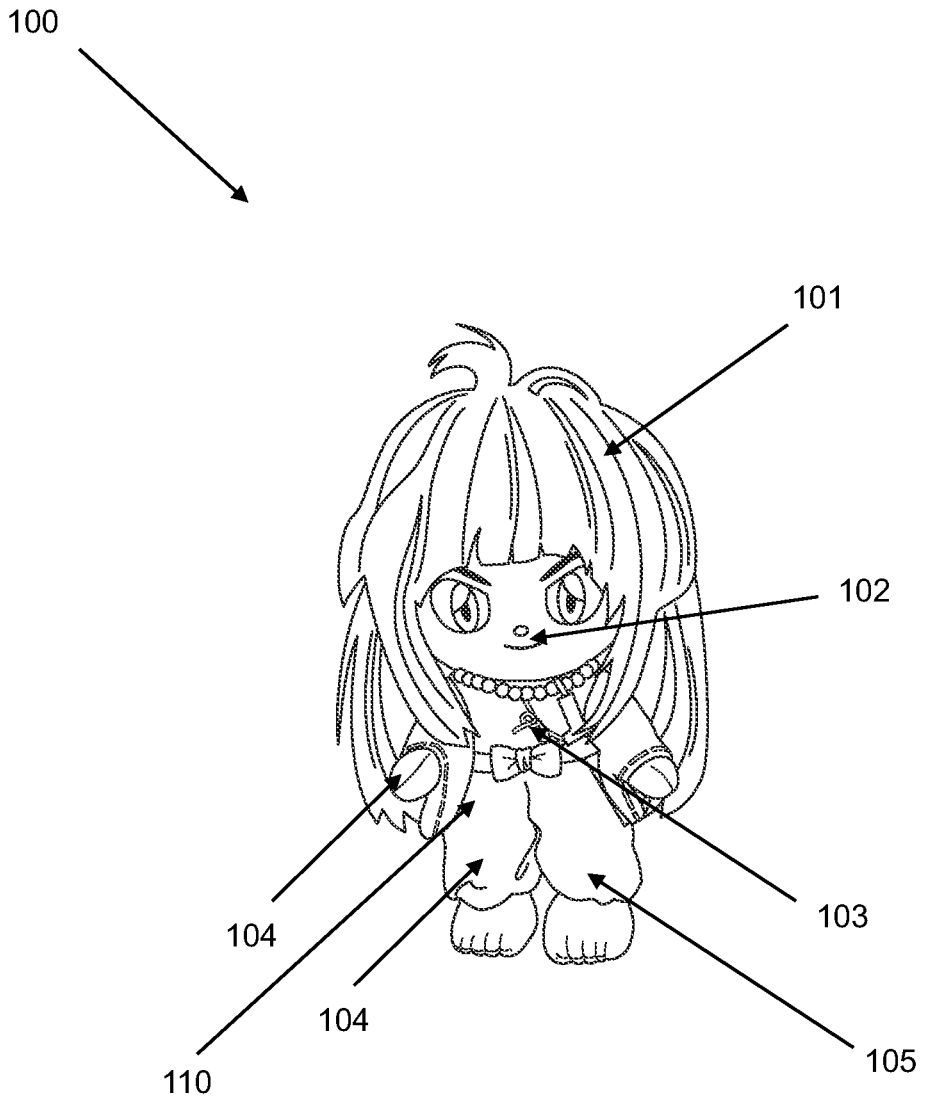
FIG. 1 is a front view of the plush toy with removable wig.

FIG. 1 is a front facing view of the present invention plush toy with removable wig 100. Wig 101 is shown installed on the head 102 of the doll. Wig 101 is removable from the head and is constructed of any material suitable for dolls, in the preferred embodiment made of high-temperature fiber. Other suitable materials include synthetic simulated hair, human hair, animal hair, yarn or any other material well known in the art. The wig may be manufactured by any method well known in the art including weaving hair into wefts (hair shafts that are woven together at one end into a long strip). These wefts then are sewn in rows into a net foundation. Wigs may also be hand tied, or manufactured by any other method well known in the art.

Wig 101 is attachable and detachable from head 102. In some cases, wig 101 uses hook and loop fasteners (Velcro™) or other suitable fasteners to secure wig 101 to head 102. Wig 101 may also be permanently attached to head 102 by sewing, with glue or other suitable fastening methods well known in the art.

Head 102 covered with plush cover 105 and filled with stuffing material 110. Plush cover 105 is made of plush material which may be one or more of many materials well known in the art including but not limited to soft boa fabric, tricot fabric, pearl velvet cloth, wide wale soft boa, polar fleece, velboa, printed polyester, polyester plush (pile) material, pile textiles, cotton, mohair, wool, worsted yarn, and simulated fur. Stuffing material 110 is polyester fiber in the preferred embodiment but other suitable materials well known in the art can be used such as: polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans.

Body 103 is also formed by plush cover 105 and is filled with stuffing material 110. The plush exterior materials and stuffing materials are the same as for head 102. Also shown are posable limbs 104, in this case arms and legs. A skeleton structure (discussed in relation to later figures) is also contained within body 103. This skeleton structure provides the necessary structure to allow the plush doll to stand and have posable limbs.

The plush cover 105, covering head 102 and body 103, may be assembled using any of many methods well known in the art, but in the preferred embodiment, the fabric exterior (plush) is sewn together utilizing a sewing machine. The various pieces of the exterior of the plush toy are cut into suitable pieces and sewn together to form the exterior. This can be done manually by a human being or by utilizing automated sewing devices well known in the art.

Figure 2:
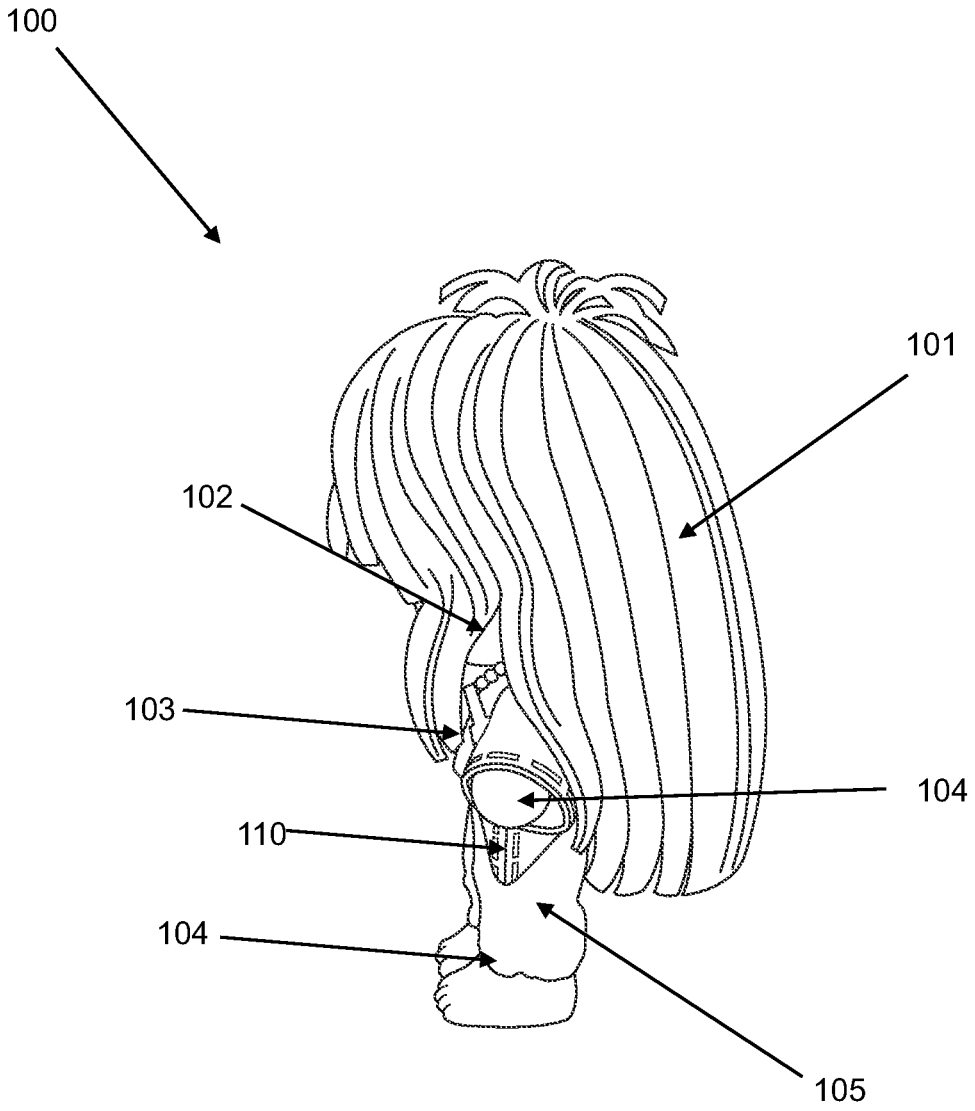
FIG. 2 is a side view of the plush toy with removable wig.

FIG. 2 is a side view of plush toy with removable wig 100. Wig 101 is shown attached to head 102. Body 103 and posable limbs 104 are also shown in this view. Plush cover 105 covers head 102 and body 103 and is filled with stuffing material 110.

Figure 3:
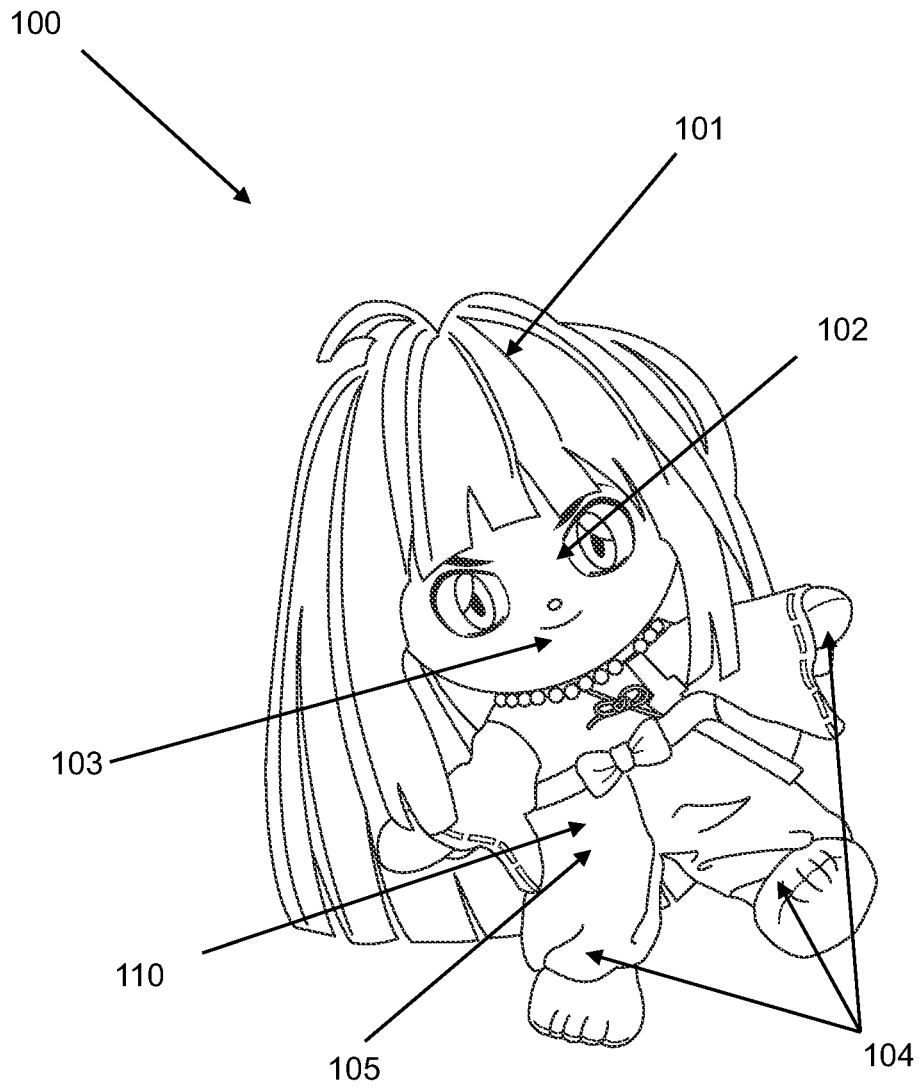
FIG. 3 is a front view of the plush toy with removable wig with the arms and legs posed.

FIG. 3. Is a front view of plush toy with removable wig 100 with posable limbs 104 shown in a specific posed position. Wig 101 is attached to head 102, and body 103 is also shown. Poseable limbs 104 are shown in a specific pose that is made possible due to the support provided by skeleton structure, which will be discussed in detail in relation to FIG. 4. Plush cover 105 covers head 102 and body 103 and is filled with stuffing material 110.

Figure 4:
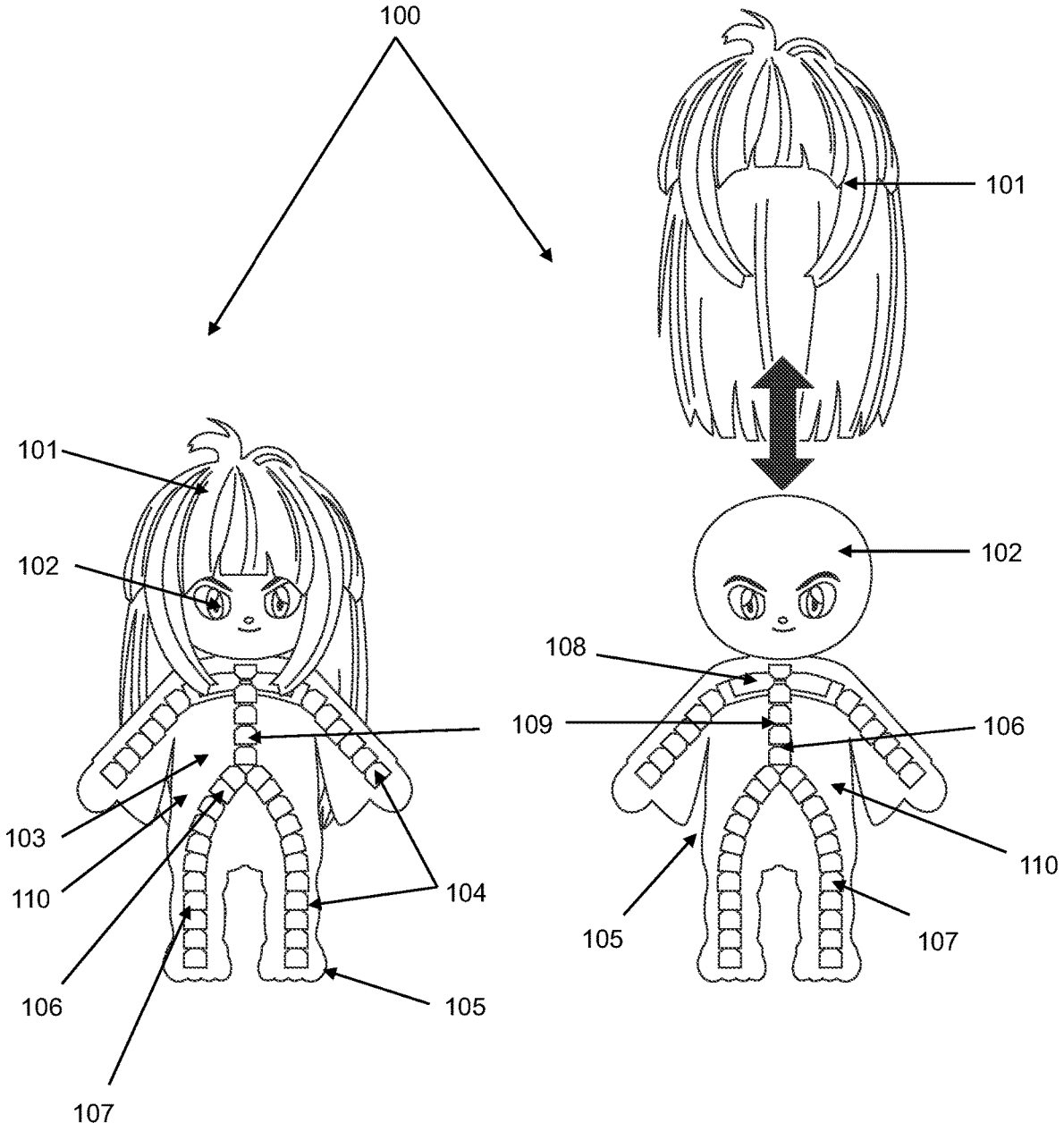
FIG. 4 is a front of view of the plush toy with removable wig with the skeleton visible and the wig removed.

FIG. 4 is a front view of plush toy with removable wig 100 with skeleton 106 visible. This view also shows wig 101 removed from head 102. Plush cover 105 is shown over skeleton 106 as well. Further plush material retaining shoulder 108 is located at the spot where the head 102 meets the body 103 of the toy. Plush material retaining shoulder 108 is designed to assist in retaining the stuffing material in the head 102 and body 103 of plush toy with removable wig 100. Skeleton 106 is comprised of posable limbs 104 and spine 109. Each part of skeleton 108 is made up of skeleton pieces 107 that, in the preferred embodiment, are made of plastic with both female and male coupling ends. The male coupling end fits into the female coupling end of another skeleton piece 107 such that they become attached but can also move rotationally within the coupling end. This movement allows skeleton 106 to be moveable and poseable for the enjoyment of the user. The arms, legs and body can be moved into various positions and held there by skeleton 106.

Body 103 is comprised of skeleton 106, stuffing 110 and plush cover 105. Stuffing 110 fits over and around skeleton 106 and provides the soft feeling desired in plush toys. Stuffing 110 is polyester fiber in the preferred embodiment but other suitable materials well known in the art can be used such as: polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans. Plush cover 105 forms the exterior of the plush toy and includes the preferred exterior design of the toy. Plush cover 105 can be manufactured using any of many methods well known in the art, but in the preferred embodiment, the fabric exterior (plush) is sewn together utilizing a sewing machine. The various pieces of the exterior of the plush toy are cut into suitable pieces and sewn together to form the exterior. This can be done manually by a human being or by utilizing automated sewing devices well known in the art. Plush cover 105 may be made from any material well known in the art, including but not limited to soft boa fabric, tricot fabric, pearl velvet cloth, wide wale soft boa, polar fleece, velboa, printed polyester, polyester plush (pile) material, pile textiles, cotton, mohair, wool, worsted yarn, simulated fur, real fur, silk with a cotton backing, terry cloth and any other fabric well known in the art.

Wig 101 is shown in both its attached and detached positions. Wig 101 may be secured to head 102 with materials that allow wig 101 to be secured and reattached such as hook and loop fasteners. Any type of attachable, detachable and reattachable securing method known in the art may be used. Wig 101 may also be more permanently fixed to head 102 by sewing, glue or any other secure attachment means well known in the art.

Although the present invention has been described in relation to the above disclosed preferred embodiment, many modifications in design, implementation, systems and execution are possible while still maintaining the novel features and advantages of the invention. The preferred embodiment is not meant to limit the scope of the patent in any way, and it should be given the broadest possible interpretation consistent with the language of the disclosure on the whole.

The invention claimed is:

1. A plush toy with a head and a body comprising:

a plush body cover comprising the head and the body of the plush toy, the plush cover further being configured to cover an internal skeleton and to retain a stuffing material for the plush toy, the internal skeleton being flexible and comprising one or more individual skeleton pieces each with a first end and a second end, where the first end of a first skeleton piece connects to the second end of a second skeleton piece, and where the internal skeleton includes an intersection of a spine and one or more posable limbs;

a plush material retaining shoulder that retains the stuffing material within the plush body cover, the plush material retaining shoulder positioned at the intersection, curving downward from the intersection and extending along a portion of the length of the one or more limbs; and a wig configured to fit on the head of the plush toy.

2. The plush toy of claim 1 where the wig is attachable and detachable from the head of the plush toy.

3. The plush toy of claim 1 where the wig is secured to the head of the plush toy with hook and loop fastener.

4. The plush toy of claim 1 where the wig is made of a material selected from the group consisting of high-temperature fiber, synthetic simulated hair, human hair, animal hair, and yarn.

5. The plush toy of claim 1 where the wig is secured to the head of the plush toy by a method selected from the group consisting of sewing and gluing.

6. The plush toy of claim 1 where the plush body cover is selected from the group consisting of plush material, soft boa fabric, tricot fabric, pearl velvet cloth, wide wale soft boa, polar fleece, velboa, printed polyester, pile textiles, cotton, mohair, wool, worsted yarn, simulated fur, real fur, silk with a cotton backing, and terry cloth.

7. The plush toy of claim 1 where the stuffing material is selected from the group comprising polyester fiber, polyethylene pellets, expanded polyethylene, polyurethane foam, polyvinyl chloride, polypropylene, polyethylene, EVA, polyformaldehyde, polystyrene, plastic coated wire, polyurethane, synthetic fibers, batting, cotton, wool, straw, wood wool, plastic pellets and beans.

* * * * *